US006461393B1

(12) United States Patent
Krull et al.

(10) Patent No.: US 6,461,393 B1
(45) Date of Patent: Oct. 8, 2002

(54) MIXTURES OF CARBOXYLIC ACIDS, THEIR DERIVATIVES AND HYDROXYL-CONTAINING POLYMERS AND THEIR USE FOR IMPROVING THE LUBRICATING EFFECT OF OILS

(75) Inventors: Matthias Krull, Oberhausen; Werner Reimann, Frankfurt am Main, both of (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/811,306

(22) Filed: Mar. 16, 2001

(30) Foreign Application Priority Data

Mar. 16, 2000 (DE) ..... 100 12 947

(51) Int. Cl.[7] ..... C10L 1/18; C10L 1/22

(52) U.S. Cl. ..... 44/385; 44/393; 44/394; 524/282; 524/283; 524/284; 524/287; 524/294

(58) Field of Search ..... 44/385, 393, 394; 525/223; 524/282, 283, 284, 287, 294

(56) References Cited

U.S. PATENT DOCUMENTS

| | | | | |
|---|---|---|---|---|
| 4,015,063 | A * | 3/1977 | Basalay et al. | 526/331 |
| 4,211,534 | A | 7/1980 | Feldman | |
| 4,670,516 | A | 6/1987 | Sackmann et al. | |
| 4,985,048 | A | 1/1991 | Wirtz et al. | |
| 5,186,720 | A | 2/1993 | Feustel et al. | |
| 5,391,632 | A | 2/1995 | Krull et al. | |
| 5,705,603 | A | 1/1998 | Krull et al. | |
| 5,718,821 | A | 2/1998 | Krull et al. | |
| 6,010,989 | A | 1/2000 | Krull et al. | |
| 6,281,292 | B1 | 8/2001 | Krull et al. | |

FOREIGN PATENT DOCUMENTS

| | | |
|---|---|---|
| DE | 1 594 417 | 5/1970 |
| EP | 0 153 176 | 8/1985 |
| EP | 0 154 177 | 9/1985 |
| EP | 0 320 766 | 6/1989 |
| EP | 0 413 279 | 2/1991 |
| EP | 0 523 672 | 1/1993 |
| EP | 0 606 055 | 7/1994 |
| EP | 0 680 506 | 11/1995 |
| EP | 0 688 796 | 12/1995 |
| EP | 0 807 676 | 11/1997 |
| EP | 0 900 836 | 3/1999 |
| EP | 0 960 908 | 12/1999 |
| WO | WO 96/18708 | 6/1996 |
| WO | WO 96/21709 | 7/1996 |
| WO | 99/27037 | 6/1999 |
| WO | WO 99/36489 | 7/1999 |
| WO | 00/78897 | 12/2000 |

OTHER PUBLICATIONS

EPO Search Report for Application No. 01104846, mail date Jan. 17, 2002.
English abstract for WO 99/27037, Jun. 3, 1999.
U.S. application Ser. No. 09/591,236, filed Jun. 9, 2000.
U.S. application Ser. No. 09/811,307, filed Mar. 16, 2001.
German office action Oct. 16, 2000.
Ullmann's encyclopadia der Techn, Chemie, 5. Auflage, vol. A21, p. 305–413 Date unknown.
J. Poly. Sci. Macromolecular Revs., Comb–like Polymers, Structure & Properties, N.A. Plate, & V.P. Shibaev, 1974, 8, p. 117ff.
D. Wie, H. Spiekes, Wear, vol. 111, No. 2, p. 217–235, 1986.

* cited by examiner

*Primary Examiner*—Cephia D. Toomer
(74) *Attorney, Agent, or Firm*—Richard P. Silverman

(57) ABSTRACT

The invention relates to additives for improving lubricating properties of fuel oils, comprising A) 10–95% by weight of at least one oil-soluble amphiphile of the formulae 1

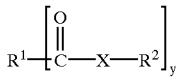

(1)

and/or 2

$$R^1—X—R^2 \quad (2)$$

B) 5-90% by weight of at least one copolymer which contains

B1) from 5 to 80 mol % of structural units which are derived from olefinically unsaturated compounds, and B2) from 20 to 95 mol % of structural units which are derived from olefinically unsaturated compounds, B3) from 0 to 40 mol % of further structural units selected from the group consisting of (meth)acrylic acid, (meth)acrylates, vinyl esters, vinyl ethers and alkenes, and the copolymer has an average molar mass Mw of from 500 to 100,000 g/mol and an OH number of from 10 to 350 mg KOH/g.

12 Claims, No Drawings

MIXTURES OF CARBOXYLIC ACIDS, THEIR DERIVATIVES AND HYDROXYL-CONTAINING POLYMERS AND THEIR USE FOR IMPROVING THE LUBRICATING EFFECT OF OILS

FIELD OF THE INVENTION

The present invention relates to an additive which comprises a long-chain carboxylic acid and/or its derivatives and one or more hydroxyl-containing polymers, fuel oils which contain such additives and the use of such additives for improving the lubricity of middle distillates.

BACKGROUND OF THE INVENTION

Mineral oils and mineral oil distillates which are used as fuel oils contain in general 0.5% by weight or more of sulfur, which results in the formation of sulfur dioxide on combustion. To reduce the resulting environmental pollution, the sulfur content of fuel oils is being increasingly reduced. The introduction of standard EN 590 relating to diesel fuels currently prescribes a maximum sulfur content of 350 ppm in Germany. In Scandinavia, fuel oils containing less than 50 ppm and in exceptional cases less than 10 ppm of sulfur are already in use. These fuel oils are produced as a rule by subjecting the fractions obtained from mineral oil by distillation to refinement involving hydrogenation. However, the desulfurization also results in the removal of other substances which impart a natural lubricating effect to the fuel oils. These substances include polyaromatic and polar compounds.

However, it has been found that the friction- and wear-reducing properties of fuel oils deteriorate with an increasing degree of desulfurization. Often, these properties are so poor that corrosion phenomena have to be expected after only a short time on the materials lubricated with fuel, for example the distributor injection pumps of diesel engines. The maximum value of 360° C. for the 95% distillation point specified according to EN 590 since the year 2000 and the further reduction of the 95% distillation point to below 350° C. and in some cases below 330° C., now implemented in Scandinavia, have further intensified these problems.

The prior art therefore describes approaches which are intended to solve this problem (so-called lubricity additives).

EP-A-0 680 506 discloses the use of esters of monobasic or polybasic carboxylic acids with monohydric or polyhydric alcohols as lubricity additives for fuel oils.

EP-A-0 802 961 discloses fuel oils which contain at least one hydroxylamine for improving their lubricating effect.

WO-99/36 489 discloses the use of mixtures of monomeric and polymeric fatty acids for improving the lubricating effect of low-sulfur middle distillates.

EP-A-0 743 974 discloses the use of mixtures of lubricity additives (esters of polyhydric alcohols and carboxylic acids having 10 to 25 carbon atoms or dicarboxylic acids) and flow improvers of ethylene/unsaturated ester copolymers for the synergistic improvement of the lubricating effect of highly desulfurized oils.

EP-A-0 807 676 discloses a fuel oil additive which increases the lubricity of said fuel oil and which, in addition to a carboxamide, comprises a cold flow improver and an ashless dispersant.

The polymeric additives of the prior art, which simultaneously improve the cold flow properties and lubricity of low-sulfur fuel oils, often have the disadvantage that, owing to their high viscosity, they have to be used as a solution or dispersion in suitable solvents in order to improve their handling. However, the use of solvents results in increased metering rates and hence in the transport of larger amounts of substances.

SUMMARY OF THE INVENTION

It was thus the object of the present invention to provide additive compositions which improve the cold flow and lubricating properties of fuel oils and are also effective when used as additives in small amounts.

DESCRIPTION OF THE PREFERRED EMBODIMENTS

Surprisingly, it was found that oil-soluble amphiphiles are very suitable as solvents for copolymers containing hydroxyl groups. In addition, lower metering rates are required than would be expected from the activity of the components.

The invention relates to additives for improving lubricating properties of fuel oils, comprising A) 10–95% by weight of at least one oil-soluble amphiphile of the formulae

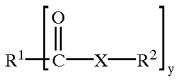

(1)

and/or 2

$$R^1—X—R^2 \quad (2)$$

in which $R^1$ is an alkyl, alkenyl, hydroxyalkyl or aromatic radical having 1 to 50 carbon atoms, X is NH, $NR^3$, O or S, y is 1, 2, 3 or 4, $R^2$ is hydrogen or an alkyl radical carrying hydroxyl groups and having 2 to 10 carbon atoms and $R^3$ is an alkyl radical carrying nitrogen and/or hydroxyl groups and having 2 to 10 carbon atoms or a $C_1$–$C_{20}$-alkyl radical, B) 5–90% by weight of at least one copolymer which contains B1) from 5 to 80 mol % of structural units which are derived from olefinically unsaturated compounds which have at least one free hydroxyl group B2) from 20 to 95 mol % of structural units which are derived from olefinically unsaturated compounds which carry a hydrocarbon radical having at least 6 carbon atoms, and, if required, B3) from 0 to 40 mol % of further structural units selected from the group consisting of (meth)acrylic acid, (meth)acrylates, vinyl esters, vinyl ethers and alkenes, with the proviso that the structural units stated under c) differ from the structural units stated under a) and b), and the copolymer has an average molar mass Mw of from 500 to 100,000 g/mol and an OH number of from 10 to 350 mg KOH/g.

The invention furthermore relates to fuel oils which contain said additives.

The invention furthermore relates to the use of the additives for improving the lubricating properties of fuel oils.

The invention furthermore relates to a process for improving the lubricity of fuel oils.

The oil-soluble amphiphile (component A) comprises preferably a radical $R^1$ having 5 to 40, in particular 12 to 26, carbon atoms. Particularly preferably, $R^1$ is linear or branched and, in the case of linear radicals, contains from 1 to 3 double bonds. The radical R preferably has 2 to 8, particularly 2 to 6 carbon atoms and may be interrupted by nitrogen and/or oxygen atoms. In a further preferred embodiment, the sum of the carbon atoms of $R^1$ and $R^2$ is at least 10, in particular at least 15 and not more than 35, in particular not more than 28, carbon atoms. In a further preferred embodiment, the component A carries from 2 to 5 hydroxyl groups, each carbon atom carrying not more than one hydroxyl group.

In a preferred embodiment of the invention, X in the formula 1 is oxygen. These compounds are in particular fatty acids and esters of carboxylic acids and dihydric or polyhydric alcohols. Preferred esters contain at least 10, in particular at least 12, carbon atoms. It is also preferred if the esters contain free hydroxyl groups, i.e. the esterification of the polyol with the carboxylic acid is not complete. Suitable polyols are, for example, ethylene glycol, diethylene glycol and higher alkoxylation products, glycerol, trimethylolpropane, pentaerythritol and sugar derivatives. Further polyols containing hetero atoms, such as triethanolamine, are also suitable. In a further preferred embodiment of the invention, the compounds which form the component A of the additive are fatty acids having 10 to 22 carbon atoms. These may be saturated or unsaturated.

Preferred components A are straight-chain saturated fatty acids having up to 18 carbon atoms, such as caprylic acid (octanoic acid), capric acid (decanoic acid), lauric acid (dodecanoic acid), myristic acid (tetradecanoic acid), palmitic acid (hexadecanoic acid), stearic acid (octadecanoic acid), and in particular unsaturated fatty acids, such as oleic acid (octadecenoic acid), linoleic acid, linolenic acid and mixtures thereof, such as, for example, rapeseed oil acid, soybean fatty acid, sunflower fatty acid, peanut fatty acid and tall oil fatty acid. Furthermore, dimeric and oligomeric fatty acids, as formed in the oligomerization of unsaturated fatty acids, may be present. Preferably, at least 50%, in particular more than 70%, especially more than 90%, of the fatty acids have at least one double bond.

Oil-soluble partial esters of these fatty acids with polyols, such as, for example, ethylene glycol, diethylene glycol and higher oligomers of alkylene oxides and glycerol, pentaerythritol, sorbitol, diethanolamine, triethanolamine and alkoxylated polyamines, are furthermore preferred. Glyceryl monooleate is particularly preferred. Esters which carry at least two free OH groups and an alkyl radical having at least 8 carbon atoms are especially preferred. The esters preferably have OH numbers of from 10 to 200 mg KOH/g, preferably from 20 to 150 mg KOH/g. If X is a nitrogen-containing radical, reaction products of ethanolamine, diethanolamine, hydroxypropylamine, dihydroxypropylamine, n-methylethanolamine, diglycolamine and 2-amino-2-methylpropanol are suitable. The reaction is preferably carried out by amidation, the resulting amides also carrying free OH groups. Fatty acid monoethanolamides, fatty acid diethanolamides and fatty acid N-methylethanolamides may be mentioned as examples. $R^3$ is preferably methyl or ethyl.

In one embodiment, the multifunctional additive may contain, as component A, compounds of the formula 3

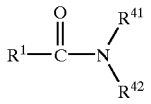

(3)

in which $R^1$ has the abovementioned meaning, $R^{41}$ is a radical of the formula 3a $$—(R^{43}—NR^{44})_m—R^{45} \quad (3a)$$

and $R^{42}$ is a radical of the formula 3b $$—(R^{43}—NR^{44})_n—R^{45} \quad (3b),$$

$R^{43}$ is a $C_2$- to $C_{10}$-alkylene group, $R^{44}$ is hydrogen, methyl, $C_2$- to $C_{20}$-alkyl, a radical of the formula 3c

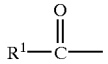

(3c)

or an alkoxy radical, and $R^{45}$ is H or a radical of the formula 3c, and m and n, in each case independently of one another, are an integer from 0 to 20, a) m and n preferably not simultaneously being zero and b) the sum of m and n being at least 1 and not more than 20.

$R^{43}$ is preferably a $C_2$- to $C_8$-radical, in particular a $C_2$- to $C_4$-radical. The polyamine from which the structural unit formed from $R^{41}$, $R^{42}$ and the nitrogen atom linking them is derived is preferably ethylenediamine, diethylenetriamine, triethylenetetramine, tetraethylenepentamine or a higher homolog of aziridine, such as polyethyleneimine, and mixtures thereof. Some of the amino groups may be alkylated. Star amines and dendrimers are also suitable. These are understood as meaning polyamines having in general 2–10 nitrogen atoms which are linked to one another via $—CH_2—CH_2—$ groups and which are saturated by acyl or alkyl radicals in the outer position.

$R^{44}$ is preferably nitrogen, an acyl radical or an alkoxy group of the formula $—(OCH_2CH_2)_n—$, where n is an integer from 1 to 10, or a mixture thereof.

Other suitable amphiphiles are compounds of the formula 3d

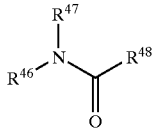

(3d)

in which $R^{46}$ may have the same meaning as $R^1$, $R^{47}$ may have the same meaning as $R^1$ or is H or $—[CH_2—CH_2—O—]_p—H$ and $R^{48}$ may have the same meaning as $R^2$ and p is an integer from 1 to 10, with the proviso that at least one of the radicals $R^{46}$, $R^{47}$ and $R^{48}$ carries an OH group. γ-Hydroxybutyric acid tallow fatty amide may be mentioned as an example.

The amides are generally prepared by condensation of the polyamines with the carboxylic acids or their derivatives, such as esters or anhydrides. Preferably from 0.2 to 1.5 mol, in particular from 0.3 to 1.2 mol, especially 1 mol, of acid are used per base equivalent. The condensation is preferably carried out at temperatures of from 20 to 300° C., in particular from 50 to 200° C., with removal of the water of reaction by distillation. For this purpose, solvents, preferably aromatic solvents, such as benzene, toluene, xylene, trimethylbenzene and/or commercial solvent mixtures, such as, for example, Solvent Naphtha, ®Shellsol AB, ®Solvesso 150 or ®Solvesso 200, may be added to the reaction mixture. The products according to the invention generally have a titratable base nitrogen content of 0.01–5% and an acid number of less than 20 mg KOH/g, preferably less than 10 mg KOH/g.

y preferably assumes the value 1 or 2. Examples of preferred groups of compounds having y=2 are derivatives of dimeric fatty acids and alkenylsuccinic anhydrides. The latter may carry linear as well as branched alkyl radicals, i.e. they may be derived from linear a-olefins and/or from oligomers of lower $C_3$–$C_5$-olefins, such as poly(propylene) or poly(isobutylene).

Preferred polyols have 2 to 8 carbon atoms. They preferably carry 2, 3, 4 or 5 hydroxyl groups, but no more than the carbon atoms they contain. The carbon chain of the polyols may be straight, branched, saturated or unsaturated and, if required, may contain hetero atoms. It is preferably saturated.

Preferred carboxylic acids from which the radical $R^1$ is derived have 5 to 40, in particular 12 to 30, carbon atoms. Preferably, the carboxylic acid has one or two carboxyl groups. The carbon chain of the carboxylic acids may be straight, branched, saturated or unsaturated. Preferably, more than 50% of the carboxylic acids (mixtures) used contain at least one double bond. Examples of preferred carboxylic acids include caprylic acid, capric acid, lauric acid, myristic acid, palmitic acid, stearic acid, oleic acid, elaidic acid, linoleic acid, linolenic acid and behenic acid, as well as carboxylic acids having hetero atoms, such as ricinoleic acid. Furthermore, dimeric and trimeric fatty acids, as are obtainable, for example, by oligomerization of unsaturated fatty acids, and alkenylsuccinic acids may be used.

In a preferred embodiment, ethers and amines of the formula 2 are used as component A. These are partial ethers of polyols, such as, for example, glyceryl monooctadecyl ether or amines carrying hydroxyl groups, as obtainable, for example, by alkoxylation of amines of the formula $R^1NH_2$ or $R^1R^3NH$ with alkylene oxides, preferably ethylene oxide and/or propylene oxide. Preferably, 1–10, in particular 1–5, mol of alkylene oxide are used per H atom of the nitrogen.

The copolymer which forms component B of the additive according to the invention contains free OH groups.

In a preferred embodiment of the invention, the copolymer has an OH number of from 10 to 300, in particular from 20 to 250, mg KOH/g. In a further preferred embodiment, the copolymer has an average molecular weight Mw of from 700 to 10,000 g/mol. In a further preferred embodiment, the proportion of structural units (B1) is from 10 to 70 mol %, in particular from 15 to 60 mol %.

The olefinically unsaturated compounds which are the comonomers (B1) are preferably vinyl esters, acrylates, mono- and diesters of ethylenically unsaturated carboxylic acids, methacrylates, alkyl vinyl ethers and/or alkenes, which carry hydroxyalkyl, hydroxyalkenyl, hydroxycycloalkyl or hydroxyaryl radicals. These radicals contain at least one hydroxyl group which may be in any desired position of the radical but is preferably at the chain end ((ω-position) or in the para-position in the case of ring systems.

The vinyl esters are preferably those of the formula 4

$$CH_2{=}CH{-}OCOR^4 \quad (4)$$

in which $R^4$ is $C_1$–$C_{30}$-hydroxyalkyl, preferably $C_1$–$C_{16}$-hydroxyalkyl, especially $C_2$–$C_{12}$-hydroxyalkyl and the corresponding hydroxyoxalkyl radicals. Suitable vinyl esters include 2-hydroxyethyl vinyl esters, α-hydroxypropyl vinyl esters, 3-hydroxypropyl vinyl esters and 4-hydroxybutyl vinyl esters.

The acrylates are preferably those of the formula 5

$$CH_2{=}CR^5{-}COOR^6 \quad (5)$$

in which $R^5$ is hydrogen or methyl and R is $C_1$–$C_{30}$-hydroxyalkyl, preferably $C_1$–$C_{16}$-hydroxyalkyl, especially $C_2$–$C_{12}$-hydroxyalkyl and the corresponding hydroxyoxalkyl radicals. Suitable acrylates include hydroxyethyl acrylate, hydroxyethyl methacrylate, 2-hydroxypropyl acrylate, 3-hydroxypropyl acrylate, 3-hydroxypropyl methacrylate, hydroxyisopropyl acrylate, 4-hydroxybutyl acrylate and glyceryl monoacrylate. The corresponding esters of methacrylic acid and esters of ethylenically unsaturated dicarboxylic acids, such as maleic acid, fumaric acid or itaconic acid, with diols are just as suitable.

The alkyl vinyl ethers are preferably compounds of the formula 6

$$CH_2{=}CH{-}OR^7 \quad (6)$$

in which $R^7$ is $C_1$–$C_{30}$-hydroxyalkyl, preferably $C_1$–$C_{16}$-hydroxyalkyl, especially $C_2$–$C_{12}$-hydroxyalkyl and the corresponding hydroxyoxalkyl radicals. Suitable alkyl vinyl ethers include 2-hydroxyethyl vinyl ether, hydroxypropyl vinyl ether, hexanediol monovinyl ether, 4-hydroxybutyl vinyl ether, diethylene glycol monovinyl ether and cyclohexanedimethanol monovinyl ether.

The alkenes are preferably monounsaturated hydroxyhydrocarbons having 3 to 30 carbon atoms, in particular 4 to 16 carbon atoms and especially 5 to 12 carbon atoms. Suitable alkenes include dimethylvinylcarbinol (=2-methyl-3-buten-2-ol), allyloxypropanediol, 2-butene-1,4-diol, 1-buten-3-ol, 3-buten-1-ol, 2-buten-1-ol, 1-penten-3-ol, 1-penten-4-ol, 2-methyl-3-buten-1-ol, 1-hexen-5-ol, 5-hexen-1-ol and 7-octene-1,2-diol.

Preferred comonomers (B2) are olefinically unsaturated compounds which carry hydrocarbon radicals having at least 6 carbon atoms (excluding the olefinic group required for the polymerization). These hydrocarbon radicals may be linear, branched, cyclic and/or aromatic. In addition to hydrocarbon groups, they may also carry minor amounts of further functional groups having hetero atoms, such as, for example nitro, halogen, cyano or amino groups, provided that they do not impair the oil solubility. These are preferably monomers from the following groups:

b1) Vinyl esters of carboxylic acids having at least 7 carbon atoms, such as, for example, octylvinyl esters, 2-ethylhexylvinyl esters, vinyl laurate, octadecylvinyl esters, vinyl neononanoate, vinyl neodecanoate and vinyl neoundecanoate.

b2) (Meth)acrylates with alcohols having at least 6 carbon atoms, such as, for example, octyl acrylate, 2-ethylhexyl acrylate, decyl acrylate, dodecyl acrylate, tetradecyl acrylate, hexadecyl acrylate, and the corresponding esters of methacrylic acid and esters of ethylenically unsaturated dicarboxylic acids, such as maleic acid, fumaric acid or itaconic acid b3) Alkyl vinyl ethers which carry at least one $C_6$-alkyl radical, such as, for example, octadecyl vinyl ether b4) Olefins and vinylaromatics having chain lengths of at least 6 carbon atoms, such as, for example, 1-octene, 1-decene, 1-dodecene, 1-tetradecene, 1-hexadecene, 1-octadecene, 1-eicosene, industrial α-olefin cuts, such as $C_{20}$–$C_{24}$-α-olefin, $C_{24}$–$C_{28}$-α-olefin, $C_{30+}$-α-olefin, styrene, α-methylstyrene and p-methoxystyrene.

It is also possible to use both individual comonomers B2 and mixtures of different comonomers of the individual and/or different monomers b1) to b4). Particularly preferred comonomers B2 are the abovementioned olefinically unsaturated compounds of groups b1) to b4) having hydrocarbon radicals which comprise at least 8 carbon atoms. Preferably, at least 10 mol %, particularly preferably at least 25 mol %, in particular more than 50 mol %, of the monomers B2 carry linear hydrocarbon radicals. Preferably, the proportion of comonomers B2 in the polymers according to the invention is from 30 to 90 mol %, in particular from 40 to 80 mol %.

If required, up to 40 mol % of acrylic acid or methacrylic acid, acrylates, such as methyl acrylate, ethyl acrylate, butyl acrylate, and the corresponding methacrylates, vinyl esters, such as vinyl acetate, vinyl propionate, hexylvinyl esters, such as ethylene, propene, butene, isobutene, pentene, hexene, 4-methylpentene, diisobutylene and norbornene, may be present as further comonomers B3. Nitrogen-containing monomers may also be present, such as, for example, a) aminoalkyl acrylates and methacrylates, such as, for example, aminoethyl acrylate, aminopropyl acrylate, amino-n-butyl acrylate, N-methylaminoethyl acrylate, N,N-dimethylaminoethyl acrylate, N,N-diethylaminoethyl acrylate, N,N-dimethylaminopropyl acrylate, N,N-diethylaminopropyl acrylate and the corresponding methacrylates, b) alkylacrylamides and alkylmethacrylamides, such as, for example, ethylacrylamide, butylacrylamide, N-octylacrylamide, N-propyl-N-methoxyethylacrylamide, N-acryloylphthalimide, N-acryloylsuccinimide, N-methylolacrylamide and the corresponding methacrylamides, c) vinylamides, such as, for example, N-vinyl-N-methylacetamide and N-vinylsuccinimide, d) aminoalkyl vinyl ethers, such as, for example, aminopropyl vinyl ether, diethylaminoethyl vinyl ether and diethylaminopropyl vinyl ether, e) allylamine, N-allyl-N-methylamine, N-allyl-N-ethylamine and diallylamine, and f) a heterocycle carrying a vinyl group, such as, for example, N-vinylpyrrolidone, methylvinylimidazole, 2-vinylpyridine, 4-vinylpyridine, 2-methyl-5-vinylpyridine, vinylcarbazole, vinylimidazole, N-vinyl-2-piperidone and N-vinylcaprolactam.

In order to achieve easier handling and better solubility of the additives, preferably up to 20 mol %, in particular up to 10 mol %, of the comonomers B2 and, if required B3 contain branched alkyl chains. Oligomers and polymers of lower olefins such as, for example, poly(propylene), poly(butene) and poly(isobutylene), are also suitable, those oligomers having a high proportion of terminal double bonds (>50 mol %, preferably >70 mol %, in particular >75 mol %) being preferred.

The melt viscosities of the copolymers at 140° C. are preferably below 10,000 mPas, in particular from 10 to 2000 mPas and especially from 15 to 1000 mPas. In the context of the invention, oil-soluble means that at least 10% by weight, preferably at least 1% by weight, in particular at least 0.1% by weight, of the additive is soluble in the middle distillate into which the additive is to be introduced and gives a clear solution.

The copolymers which form the component B of the additive according to the invention can be prepared by direct polymerization of compounds which contain the stated structural units. It is also possible to prepare them by a polymer-analogous reaction.

For this purpose, it is necessary to prepare a polymer having free acid groups. These originate from the copolymerization of an olefinically unsaturated carboxylic acid or such a derivative of carboxylic acid with further comonomers B1, and if required, B2 defined here. These carboxylic acids and carboxylic acid derivatives are preferably maleic acid, acrylic acid, methacrylic acid, fumaric acid or itaconic acid and derivatives thereof. The monomers B1 carrying hydroxyl groups are prepared therefrom in a polymer-analogous reaction.

Preferred derivatives of the carboxylic acids are their anhydrides. Maleic anhydride is particularly preferred. In the case of copolymers of maleic anhydride (MAA) with α-olefins, alternating copolymers which contain from about 40 to 60 mol % of MAA and 6–40% of α-olefin are preferred.

For the preparation of the copolymers according to the invention by means of polymer-analogous reaction, the polymeric acid groups are reacted with at least bifunctional reagents which carry at least one OH function. The bonding to the polymer may take place via hydroxyl groups as ester and/or via primary or secondary amino groups in the form of amides, imides and/or ammonium salts. In order to avoid crosslinking reactions, it is possible to employ, for example, an excess of bifunctional reagent and/or a high dilution. The esterification, amidation or imidation is carried out as a rule with removal of water of reaction (azeotropic distillation, expulsion with gas stream, such as $N_2$). The residual acid number is brought to values of <150, preferably <20, in particular <10 mg, KOH/g. Examples of suitable reagents are ethylene glycol, propylene glycol, diethylene glycol, triethylene glycol, trimethylolpropane, mixed alkoxylates of ethylene oxide, propylene oxide and/or butylene oxide comprising up to 50, in particular up to 10 units derived from ethylene oxide, propylene oxide and/or butylene oxide, glycerol, pentaerythritol, sorbitol, ethanolamine, diethanolamine, triethanolamine, butyldiethanolamine, methyl diisopropylamine, aminopropanediol and alkoxylated polyamines. The latter may be derived, for example, from ethylenediamine, hexamethylenediamine, diethylenetriamine, triethylenetetramine, tetraethylenepentamine and their higher homologs, which are alkoxylated with from 0.5 to 50, in particular 10, mol of ethylene oxide, propylene oxide and/or butylene oxide per H atom bonded to a N atom. The reaction with the polymer can be effected both via an OH group to give the ester and via a primary or secondary amino group to give the amide or imide.

The reaction of the copolymers containing acid groups is carried out at from 30 to 250° C. in the course of from 0.5 to 20 hours. The hydroxy-functional reagent is reacted with amounts of from about 1 to about 2 mol per mole of polymerized acid (derivative).

In order to establish a lower OH number for a given base polymer and hence to improve the oil solubility, up to 50 mol % of the hydroxy-functional reagent can be replaced by alkylamines and/or alcohols having up to 24 carbon atoms. Furthermore, the copolymers B can be obtained by oxalkylation of the copolymers containing acid groups. Copolymers suitable for this purpose are, for example, those of acrylic acid, methacrylic acid, itaconic acid, fumaric acid, maleic acid or maleic anhydride with the comonomers B2 and, if required, B3. These are oxalkylated at the acid groups with $C_1$- to $C_{10}$-alkylene oxides. Preferred alkylene oxides are ethylene oxide, propylene oxide and butylene oxide. The oxalkylation is preferably effected using from 0.5 to 10 mol, in particular from 1 to 5 mol and especially from 1 to 2 mol of alkylene oxide per mole of acid group.

The copolymerization of the comonomers is carried out by known batchwise or continuous polymerization methods (in this context, cf. for example Ullmanns Encyclopädie der Technischen Chemie [Ullmann's Encyclopedia of Industrial Chemistry], 5th Edition, Vol. A21, pages 305 to 413). Polymerization in solution, in suspension and in the gas phase and precipitation and mass polymerization are suitable. Mass and solution polymerization are preferred. The reaction of the comonomers is initiated by free radical initiators (free radical chain initiators). This class of substances includes, for example, oxygen, hydroperoxides, peroxides and azo compounds, such as cumyl hydroperoxide, tert-butyl hydroperoxide, dilauroyl peroxide, dibenzoyl peroxide, bis(2-ethylhexyl) peroxodicarbonate, tert-butyl permaleate, tert-butyl perpivalate, tert-butyl perbenzoate, dicumyl peroxide, tert-butyl cumyl peroxide, di(tert-butyl) peroxide, 2,2'-azobis(2-methylpropanonitrile) and 2,2'-azobis(2-methylbutyronitrile). The initiators are used individually or as a mixture of two or more substances, in amounts of from 0.01 to 20% by weight, preferably from 0.05 to 10% by weight, based on the comonomer mixture.

The polymerization is effected as a rule at temperatures of 40–300° C., preferably at 80–250° C., it being expedient to employ superatmospheric pressure when monomers and/or solvents having boiling points below the polymerization temperature are used. The polymerization is expediently carried out in the absence of air, for example under nitrogen, since oxygen adversely affects the polymerization. In choosing the initiator or the initiator system, it is expedient to ensure that the half-life of the initiator or initiator system at the chosen polymerization temperature is less than 3 hours. Preferably, it is from 0.5 minutes to one hour. For a given composition of the comonomer mixture, the desired molecular weight of the copolymer is obtained by varying the reaction parameters of concentration and temperature. In order to obtain low molecular weight copolymers, it is furthermore possible to add moderators. Suitable molecular weight regulators are, for example, aldehydes, ketones, alcohols and organic sulfur compounds, such as mercaptoethanol, mercaptopropanol, mercaptoacetic acid, mercaptopropionic acid, tert-butyl mercaptan, n-butyl mercaptan, n-octyl mercaptan, tert-dodecyl mercaptan and n-dodecyl mercaptan. Depending on the desired viscosity, the moderators are used in amounts of up to 20% by weight, preferably from 0.05 to 10% by weight, based on the comonomer mixture.

Apparatuses suitable for the polymerization are, for example, conventional stirred kettles having, for example, an anchor stirrer, paddle stirrer, impeller stirrer or multistage impulse countercurrent agitator and, for the continuous preparation, stirred kettle cascades, stirred reactors or static mixers.

A preferred process for the preparation of the copolymers, in addition to solvent-free mass polymerization, is solution polymerization. It is carried out in solvents in which the monomers and the copolymers formed are soluble. All solvents which meet this requirement and which do not react with the monomers and with the copolymers formed are suitable for this purpose. For example, these are organic, preferably aromatic solvents, such as cumene, toluene, xylene, ethylbenzene or commercial solvent mixtures, such as ®Solvent Naphtha, ®Shellsol AB or ®Solvesso 150, 200.

In the preparation, all monomers can be initially taken and can be polymerized by adding a free radical initiator and supplying heat.

Expediently, however, the solvent and, if required, a part of the monomers (for example about 5–20%) are initially taken and the remainder of the monomer mixture is metered in with the initiator and, if required, coinitiator and regulator.

The concentration of the monomers to be polymerized is from 20 to 95% by weight, preferably from 50 to 90% by weight. The solid copolymer can be isolated by precipitation with suitable nonsolvents, such as acetone or methanol, or by evaporating the solvent. However, it is expedient to choose for the polymerization a solvent in which the polymer can be used directly according to the invention.

The additives according to the invention are added to the mineral oils or mineral oil distillates preferably as a mixture, the oil-soluble amphiphile A serving as a solvent for the copolymer B. Preferred mixtures are flowable at temperatures below 40° C., i.e. they have a viscosity of less than 10 Pas, in particular <1 Pas, at this temperature. If the viscosity and/or natural setting point of the mixture are too high for processing, up to 50% by weight, in particular up to 20% by weight, based on the additive, of a solvent may be added. Solvents may be aliphatic and/or aromatic hydrocarbons. The advantages of the additive combination according to the invention can how ever also be utilized in the case of separate metering of the components A and B.

Mineral oils or mineral oil distillates improved in their lubricating and/or cold flow properties by means of the additives contain from 0.001 to 2, preferably from 0.005 to 0.5, % by weight of additive, based on the distillate. The additives according to the invention may furthermore be used in the form of mixtures which comprise additives of the claimed type but of different qualitative and/or quantitative composition. The mixing ratio (in parts by weight) of the additive components may be varied over a wide range and may be, for example, from 20:1 to 1:20, preferably from 10:1 to 1:10. In this way, the additives can be adapted specifically to individual requirements.

For the preparation of additive packets for solving specific problems, the additives according to the invention can also be used together with one or more oil-soluble coadditives which by themselves improve the cold flow properties and/or lubricating effect of crude oils, lubricating oils or fuel oils. Examples of such coadditives are vinyl acetate-containing copolymers or terpolymers of ethylene, polar compounds which disperse paraffins (paraffin dispersants), comb polymers, alkylphenol/aldehyde resins and oil-soluble amphiphiles.

Thus, mixtures of the additives with copolymers which contain from 10 to 40% by weight of vinyl acetate and from 60 to 90% by weight of ethylene have proven to be particularly useful. According to a further embodiment of the invention, the additives according to the invention are used as a mixture with ethylene/vinyl acetate/vinyl neononanoate terpolymers or ethylene/vinyl acetate/vinyl neodecanoate terpolymers for improving the flowability of mineral oils or mineral oil distillates. The terpolymers of vinyl neononanoates or of vinyl neodecanoates contain from 10 to 35% by weight of vinyl acetate and from 1 to 25% by weight of the respective neo compound in addition to ethylene. Further preferred copolymers contain, in addition to ethylene and from 10 to 35% by weight of vinyl esters, also from 0.5 to 20% by weight of olefin, such as diisobutylene, 4-methylpentene or norbornene. The mixing ratio of the additives according to the invention with the ethylene/vinyl acetate copolymers described above or the terpolymers of ethylene, vinyl acetate and the vinyl esters of neononanoic or neodecanoic acid is (in parts by weight) from 20:1 to 1:20, preferably from 10:1 to 1:10.

For use as flow improvers and/or lubricity additives, the additives according to the invention may furthermore be used as a mixture with paraffin dispersants. Paraffin dispersants reduce the size of the paraffin crystals and ensure that the paraffin particles do not settle out but remain dispersed in colloidal form with substantially reduced tendency to sedimentation. Furthermore, they enhance the lubricating effect of the additives according to the invention. Paraffin dispersants which have proven to be useful are oil-soluble polar compounds having ionic or polar groups, for example amine salts and/or amides, which are obtained by reacting aliphatic or aromatic amines, preferably long-chain aliphatic amines, with aliphatic or aromatic mono-, di-, tri- or tetracarboxylic acids or their anhydrides (cf. U.S. Pat. No. 4,211,534). Other paraffin dispersants are copolymers of maleic anhydride and α,β-unsaturated compounds, which, if required, may be reacted with primary monoalkylamines and/or aliphatic alcohols (cf. EP 0 154 177), the reaction products of alkenylspirobislactones with amines (cf. EP 0 413 279 B1) and, according to EP 0 606 055 A2, reaction products of terpolymers based on α,β-unsaturated dicarboxylic anhydrides, α,β-unsaturated compounds and polyoxyalkylene ethers of lower unsaturated alcohols. Alkylphenol aldehyde resins are also suitable as paraffin dispersants.

Thus, the copolymers according to the invention can be used as a mixture with alkylphenol formaldehyde resins. In a preferred embodiment of the invention, these alkylphenol formaldehyde resins are those of the formula 7

(7)

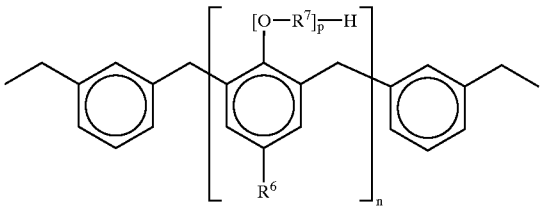

in which $R^6$ is $C_4$–$C_{50}$-alkyl or $C_4$–$C_{50}$-alkenyl, $R^7$ is ethoxy and/or propoxy, n is a number from 5 to 100 and p is a number from 0 to 50.

Finally, in a further embodiment of the invention, the additives according to the invention are used together with comb polymers. These are understood as meaning polymers in which hydrocarbon radicals having at least 8, in particular at least 10, carbon atoms are bonded to a polymer backbone. Preferably, these are homopolymers whose alkyl side chains contain at least 8 and in particular at least 10 carbon atoms. In the case of copolymers, at least 20%, preferably at least 30%, of the monomers have side chains (cf. Comb-like Polymers—Structures and Properties; N. A. Platé and V. P. Shibaev, J. Polym. Sci. Macromolecular Revs. 1974, 8, 117 et seq.). Examples of suitable comb polymers are fumarate/vinyl acetate copolymers (cf. EP 0 153 176 A1), copolymers of a $C_6$- to $C_{24}$-α-olefin and an N—$C_6$- to $C_{22}$-alkylmaleimide (cf. EP 0 320 766), and furthermore esterified olefin/maleic anhydride copolymers, polymers and copolymers of α-olefins and esterified copolymers of styrene and maleic anhydride.

Comb polymers can be described, for example, by the formula 8

(8)

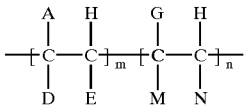

In this formula,

A is R', COOR', OCOR', R"—COOR' or OR';

D is H, $CH_3$, A or R;

E is H or A;

G is H, R", R"—COOR', an aryl radical or a heterocyclic radical;

M is H, COOR", OCOR", OR" or COOH;

N is H, R", COOR", OCOR, COOH or an aryl radical;

R' is a hydrocarbon chain having 8–150 carbon atoms;

R" is a hydrocarbon chain having 1 to 10 carbon atoms;

m is a number from 0.4 to 1.0; and n is a number from 0 to 0.6.

The mixing ratio (in parts by weight) of the additives according to the invention with paraffin dispersants, resins or comb polymers is in each case from 1:10 to 20:1, preferably from 1:1 to 10:1.

The additives according to the invention are in particular suitable for improving the lubricating properties of animal, vegetable or mineral oils. Moreover, they simultaneously improve the cold flow properties of the oils containing the additives. They are particularly suitable for use in middle distillates. Middle distillates are defined in particular as those mineral oils which are obtained by distillation of crude oil and boil within a range from 120 to 450° C., for example kerosene, jet fuel, diesel and heating oil. Preferably, the additives according to the invention are used in those middle distillates which contain 0.05% by weight of sulfur or less, particularly preferably less than 350 ppm of sulfur, in particular less than 200 ppm of sulfur and in specific cases less than 50 ppm of sulfur. These are in general those middle distillates which are subjected to refining with hydrogenation and which therefore contain only small amounts of polyaromatic and polar compounds which impart a natural lubricating reaction to them. The additives according to the invention are furthermore preferably used in those middle distillates which have 95% distillation points below 370° C., in particular 350° C. and in specific cases below 330° C. They can also be used as components in lubricating oils.

The additives can be used alone or together with other additives, for example with other pour point depressants or dewaxing assistants, with corrosion inhibitors, antioxidants, sludge inhibitors, dehazers and additives for reducing the cloud point.

EXAMPLES

The efficiency of the additives according to the invention as lubricity additives is illustrated in more detail by the examples below.

The hydroxy-functional comonomers are determined by determining the OH number by reacting the polymer with excess acetic anhydride and subsequently titrating the acetic acid formed with KOH.

The viscosity is determined according to ISO 3219 (B) using a rotational viscometer (Haake RV 20) with plate-and-cone measuring system.

TABLE 1

Characterization of the hydroxy-functional copolymers

| Sample | Copolymer |
|---|---|
| A1 | Copolymer of 50 mol % of hydroxyethyl methacrylate and 50 mol % of octadecene, having a melt viscosity at 140° C. of 70 mPas and an OH number of 185 mg KOH/g |
| A2 | Copolymer of 25 mol % of hydroxybutyl vinyl ether and 75 mol % of octadecyl vinyl ether, having a melt viscosity at 140° C. of 54 mPas and an OH number of 70 mg KOH/g |
| A3 | Terpolymer of 18 mol % of ethylene glycol monovinyl ether, 67 mol % of octadecyl acrylate and 15 mol % of vinyl acetate, having a melt viscosity at 140° C. of 82 mPas and an OH number of 35 mg KOH/g |
| A4 | Terpolymer of 50 mol % of maleic anhydride, 25 mol % of tetradecene and 25 mol % of hexadecene, having a melt viscosity at 160° C. of 50 mPas, esterified with diethylene glycol. The OH number is 225 mg KOH/g |

TABLE 2

Characterization of the oil-soluble amphiphiles

| Sample | |
|---|---|
| B1 | Oleic acid |
| B2 | Tall oil fatty acid |
| B3 | Glyceryl monooleate |
| B4 | Poly(isobutenyl)succinic anhydride, diesterified with diethylene glycol according to Example 1 of WO 97/45507 |
| B5 | Oleic acid diethanolamide |

TABLE 3

Characterization of the test oils
The boiling characteristics are determined according to ASTM D-86, the CFPP value according to EN 116 and the cloud point according to ISO 3015.

| | Test oil 1 |
|---|---|
| Initial boiling point [° C.] | 185 |
| 20% [° C.] | 201 |
| 30% [° C.] | 207 |
| 90% [° C.] | 289 |
| 95% [° C.] | 305 |
| Cloud point [° C.] | −27 |
| CFPP [° C.] | −30 |
| S content [ppm] | 13 |
| Density [g/cm$^3$] | 0.817 |
| WS 1.4 [$\mu$m] | 676 |

Lubricating Effect in Middle Distillates

The lubricating effect of the additives was determined by means of an HFRR apparatus from PCS Instruments on additive-containing oil at 60° C. The High Frequency Reciprocating Rig Test (HFRR) is described in D. Wei, H. Spikes, Wear, Vol. 111, No. 2, p. 217, 1986. The results are stated as wear scar (WS 1.4). A low wear scar indicates a good lubricating effect.

TABLE 4

Wear scar in test oil 2

| Example | Additive | Wear scar 1.4 $\mu$m |
|---|---|---|
| 1 | 200 ppm (A1 + B1/1:1) | 334 $\mu$m |
| 2 | 250 ppm (A1 + B3/2:1) | 290 $\mu$m |
| 3 | 200 ppm (A2 + B2/1:1) | 310 $\mu$m |
| 4 | 150 ppm (A2 + B5/1:1) | 370 $\mu$m |

TABLE 4-continued

Wear scar in test oil 2

| Example | Additive | Wear scar 1.4 $\mu$m |
|---|---|---|
| 5 | 175 ppm (A3 + B2/1:2) | 380 $\mu$m |
| 6 | 250 ppm (A3 + B4/2:1) | 385 $\mu$m |
| 7 | 250 ppm (A3 + B4/2:1) | 355 $\mu$m |
| 8 (Comp.) | 350 ppm (A1 in Solvent Naphtha/1:1) | 410 $\mu$m |
| 9 (Comp.) | 500 ppm (A2 in Solvent Naphtha/1:1) | 480 $\mu$m |
| 10 (Comp.) | 500 ppm (A3 in Solvent Naphtha/1:1) | 420 $\mu$m |
| 11 (Comp.) | 400 ppm (A4 in Solvent Naphtha/1:1) | 224 $\mu$m |
| 12 (Comp.) | 150 ppm B1 | 435 $\mu$m |
| 13 (Comp.) | 150 ppm B2 | 449 $\mu$m |
| 14 (Comp.) | 150 ppm B3 | 389 $\mu$m |
| 15 (Comp.) | 150 ppm B4 | 460 $\mu$m |
| 16 (Comp.) | 125 ppm B5 | 470 $\mu$m |

What is claimed is:

1. An additive for improving lubricating properties of fuel oils, comprising

A) 10–95% by weight of at least one oil-soluble amphiphile of the formulae

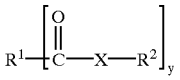

(1)

and/or 2

$$R^1—X—R^2 \quad (2)$$

in which $R^1$ is an alkyl or hydroxyalkyl radical having 1 to 50 carbon atoms, or an alkenyl or aromatic radical having 5 to 50 carbon atoms, X is NH, $NR^3$, O or S, y is 1, 2, 3 or 4, $R^2$ is hydrogen or an alkyl radical having hydroxyl groups and having 2 to 10 carbon atoms and $R^3$ is an alkyl radical having nitrogen and/or hydroxyl groups and having 2 to 10 carbon atoms or a $C_1$–$C_{20}$-alkyl radical, or $XR^2$ is $NR^{41}R^{42}$, in which $R^{41}$ is a radical of the formula 3a $$—(R^{43}—NR^{44})_m—R—^{45} \quad (3a)$$

and $R^{42}$ is a radical of the formula 3b $$—(R^{43}—NR^{44})_nR^{45} \quad (3b),$$

$R^{43}$ is a $C_2$- to $C_{10}$-alkylene group, $R^{44}$ is hydrogen, methyl, $C_2$- to $C_{10}$-alkyl, a radical of the formula 3c $$R^1—CO— \quad (3c)$$

or an alkoxy radical, and $R^{45}$ is hydrogen or a radical of the formula 3c, and m and n, in each case independently of one another, are an integer from 0 to 20, and B) 5–90% by weight of at least one copolymer which comprises B1) from 5 to 80 mol % of structural units which are derived from olefinically unsaturated compounds which have at least one free hydroxyl group, and B2) from 20 to 95 mol % of structural units which are derived from olefinically unsaturated compounds which carry a hydrocarbon radical having at least 6 carbon atoms, and the copolymer has an average molar mass Mw of from 500 to 100,000 g/mol and an OH number of from 1 0 to 350 mg KOH/g.

2. The additive as claimed in claim 1, the copolymer B having an OH number of from 20 to 250 mg KOH/g.

3. The additive as claimed in claim 1, the copolymer having an average molecular weight Mw of from 700 to 10,000 g/mol.

4. The additive as claimed in claim 1, wherein the B1 structural units comprise from 10 to 70 mol % of copolymer B.

5. The additive as claimed in claim 1, wherein the B2 structural units comprise from 30 to 90 mol % of copolymer B.

6. The additive as claimed in claim 1, the oil-soluble amphiphile being a fatty acid having 10 to 18 carbon atoms, or an ester derived from such a fatty acid.

7. A fuel oil comprising a middle distillate having a sulfur content of 0.05% by weight or less, and from 0.001 to 2% by weight of an additive as claimed in claim 1.

8. A process for improving the lubricating effect of middle distillates having a sulfur content of 0.05% by weight or less, comprising adding to said middle distillates from 0.001 to 2% by weight of the additive of claim 1.

9. An additive mixture comprising the additive as claimed in claim 1 and at least one additional additive selected from, flow improvers, comb polymers, and paraffin dispersants.

10. The additive as claimed in claim 1, wherein copolymer B further comprises B3 structural units wherein B3 comprises up to 40 mol % of further structural units selected from the group consisting of (meth)acrylic acid, (meth) acrylates, vinyl esters, vinyl ethers and alkenes, with the proviso that the structural units stated under B3) differ from the structural units stated under A) and B).

11. The additive as claimed in claim 10, wherein B3 contains branched alkyl chains.

12. The additive as claimed in claim 1, wherein a sum of carbon atoms of R1 and R2 is at least 15.

* * * * *